US008528696B2

(12) United States Patent
Astor

(10) Patent No.: US 8,528,696 B2
(45) Date of Patent: Sep. 10, 2013

(54) PIPE TRADESMAN'S LADDER TOP AND METHOD

(75) Inventor: Kyle G. Astor, Meadville, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 13/533,272

(22) Filed: Jun. 26, 2012

(65) Prior Publication Data

US 2012/0261369 A1 Oct. 18, 2012

Related U.S. Application Data

(60) Division of application No. 11/416,961, filed on May 3, 2006, now Pat. No. 8,210,313, which is a continuation-in-part of application No. 11/347,613, filed on Feb. 3, 2006.

(51) Int. Cl.
*E06C 5/32* (2006.01)

(52) U.S. Cl.
USPC ..... 182/129; 182/165; 248/210; 248/238

(58) Field of Classification Search
USPC ..... 182/129, 165; 248/210, 238
See application file for complete search history.

(56) References Cited

U.S. PATENT DOCUMENTS

| | | | | |
|---|---|---|---|---|
| 5,351,730 | A * | 10/1994 | Lewellen et al. | 144/286.1 |
| 5,419,409 | A * | 5/1995 | Corulla | 182/129 |
| 5,503,245 | A * | 4/1996 | Etesam | 182/129 |
| 5,873,433 | A * | 2/1999 | Katz | 182/129 |
| 6,481,583 | B1 * | 11/2002 | Black et al. | 211/70.6 |
| 6,880,794 | B1 * | 4/2005 | Kahn | 248/315 |
| 7,063,187 | B1 * | 6/2006 | Lavigne | 182/129 |
| D531,322 | S * | 10/2006 | Patton et al. | D25/68 |
| 2004/0149607 | A1 * | 8/2004 | Gorman | 206/349 |

* cited by examiner

*Primary Examiner* — Alvin Chin Shue
(74) *Attorney, Agent, or Firm* — Ansel M. Schwartz

(57) ABSTRACT

A ladder top for a stepladder includes a plane having a front and a rear. The plane has a bin for holding small parts and having a shape to hold a propane tank adjacent the front of the plane. The plane has at least one screwdriver hole. The plane has a drill holster. The plane has a hammer/pipe wrench hole. The plane has a channel lock slot. The plane has a pipe holder extending along the length of the pipe for holding pipe. A method for using a ladder top for a stepladder.

1 Claim, 2 Drawing Sheets

Fig 1
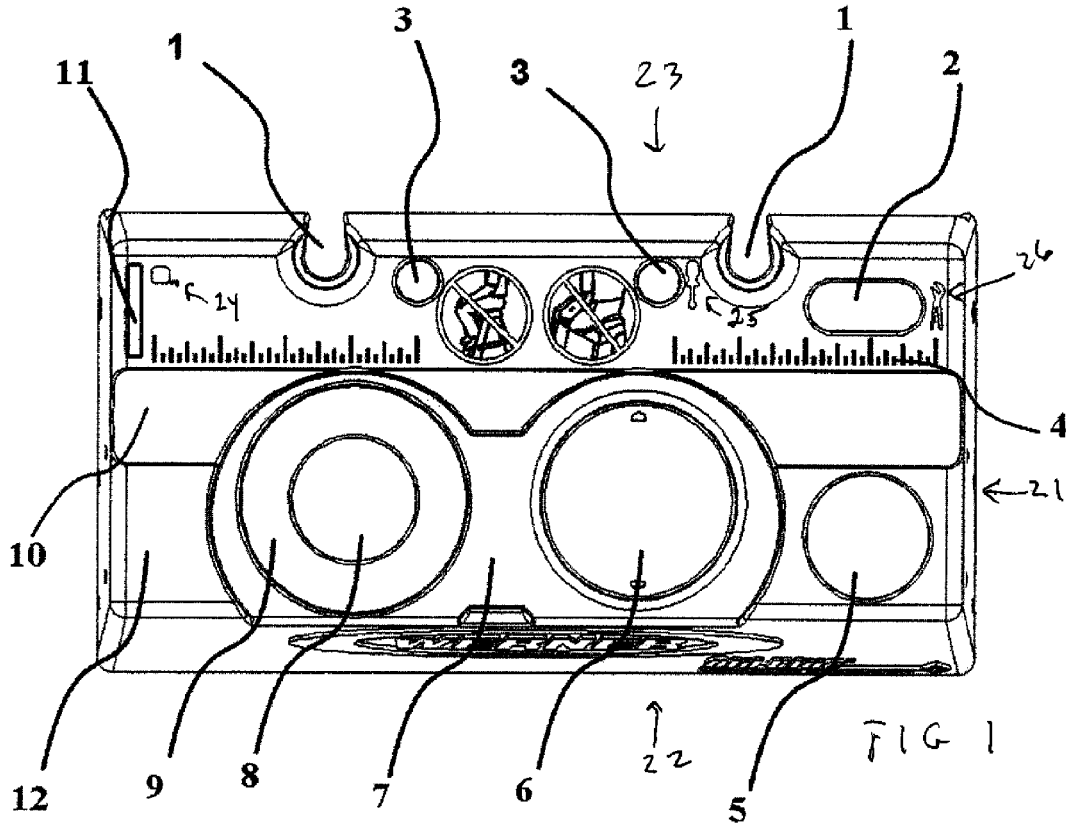
FIG 1
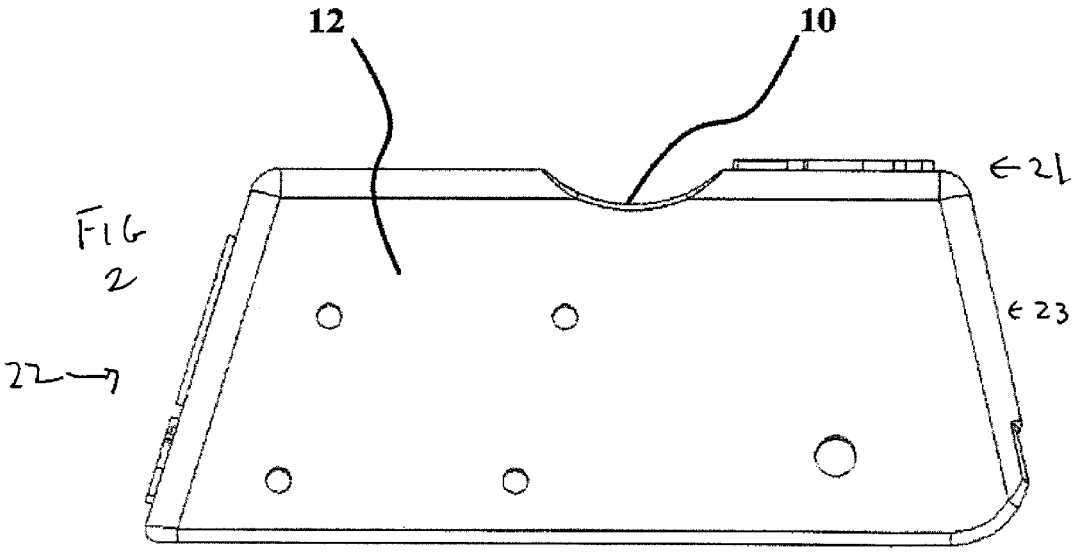
FIG 2

PIPE TRADESMAN'S LADDER TOP AND METHOD

CROSS-REFERENCE TO RELATED APPLICATIONS

This is a divisional of U.S. patent application Ser. No. 11/416,961 filed May 3, 2006, now U.S. Pat. No. 8,210,313, which is a continuation-in-part of U.S. patent application Ser. No. 11/347,613 filed Feb. 3, 2006, and which is related to contemporaneously filed U.S. patent application Ser. No. 11/416,967, titled "Pipe Tradesman's Ladder and Method", by Kyle G. Astor, James J. Grebinoski and Brett Latimer, all of which are incorporated by reference herein.

FIELD OF THE INVENTION

The present invention is related to a pipe tradesman ladder top. More specifically, the present invention is related to a pipe tradesman ladder top having features directed to facilitate the pipe tradesman work, including but not limited to a bin for holding small parts and having a shape to hold a propane tank, at least one screwdriver hole, a drill, a hammer/pipe wrench hole, a channel lock slot, and a pipe holder extending along the length of the pipe for holding pipe.

BACKGROUND OF THE INVENTION

For years, stepladders have been designed for the general construction and painting professionals needs. The new plumber's ladder described herein is designed for the specific needs of the professional plumber. New features have been added to aid in the installation of copper and PVC pipes and tubing, and storage for the tools and accessories needed to perform those tasks. Specifically, the top has been redesigned to greatly benefit the plumber while on the ladder.

SUMMARY OF THE INVENTION

The present invention pertains to a ladder top for a stepladder. The top comprises a plane having a front and a rear. The plane has a bin for holding small parts and having a shape to hold a propane tank adjacent the front of the plane. The plane has at least one screwdriver hole. The plane has a drill holster. The plane has a hammer/pipe wrench hole. The plane has a channel lock slot. The plane has a pipe holder extending along the length of the pipe for holding pipe.

The present invention pertains to a method for using a ladder top for a stepladder. The method comprises the steps of obtaining small parts from a bin in a plane. There is the step of placing at least one screwdriver in a screwdriver hole in the plane for holding the screwdriver. There is the step of placing a drill in a drill holster slot in the plane. There is the step of placing a pipe wrench in a pipe wrench hole in the plane. There is the step of placing a quart can of glue in a first quart recess disposed adjacent the second quart recess in the plane. There is the step of placing a channel lock in a channel lock slot in the plane. There is the step of placing a pipe in a pipe holder along a length of the plane.

BRIEF DESCRIPTION OF THE DRAWINGS

In the accompanying drawings, the preferred embodiment of the invention and preferred methods of practicing the invention are illustrated in which:

FIG. 1 is an overhead view of the top of the present invention.

FIG. 2 is a side view of the top.

DETAILED DESCRIPTION

Figure 3:
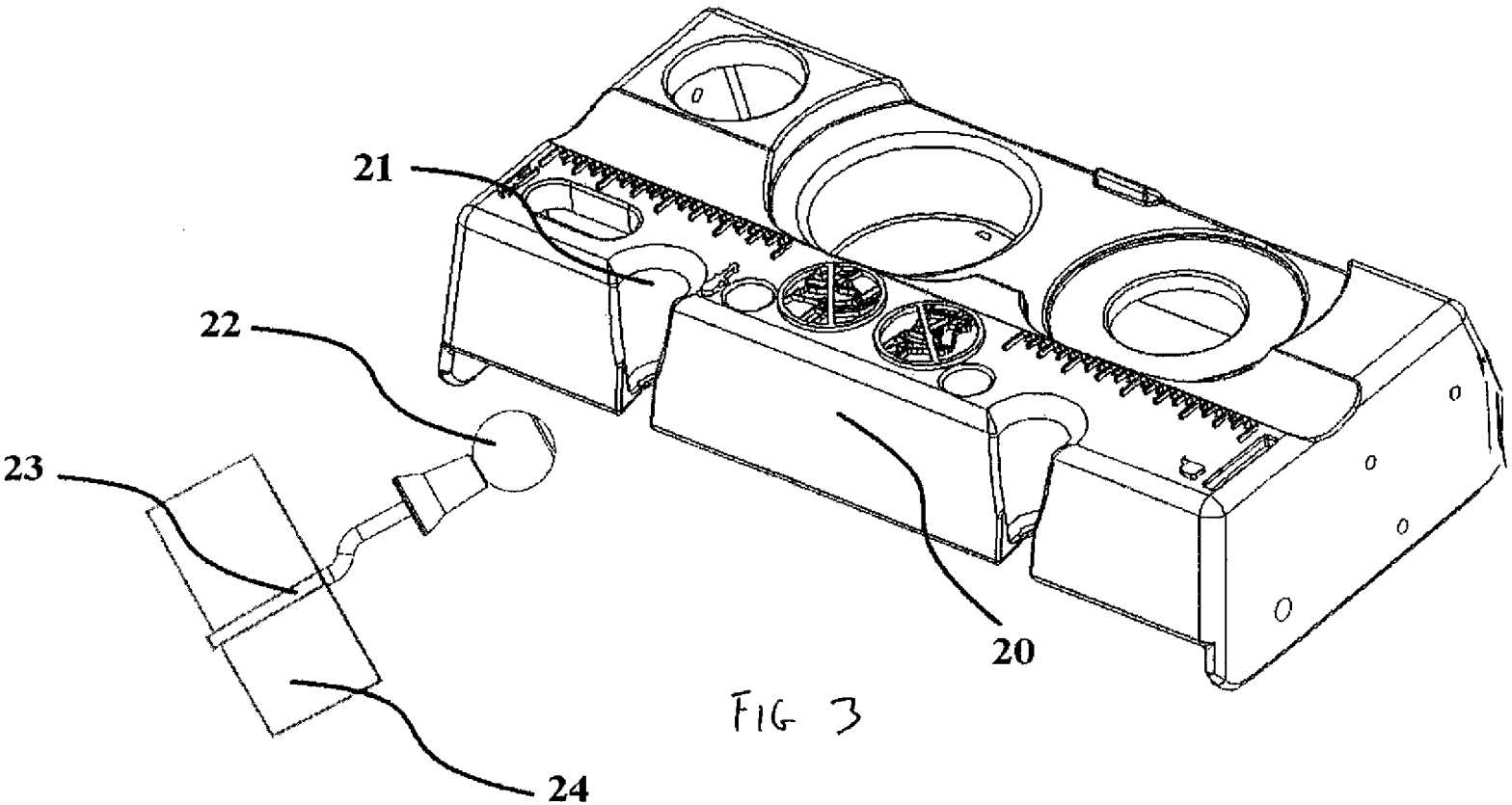
FIG. 3 is a perspective view of the top with a lasso.

Referring now to the drawings wherein like reference numerals refer to similar or identical parts throughout the several views, and more specifically to FIGS. 1-3 and thereof, there is shown a ladder top 12 for a stepladder. The top 12 comprises a plane 21 having a front 22 and a rear 23. The plane 21 has a bin 6 for holding small parts and having a shape to hold a propane tank adjacent the front 22 of the plane 21, The plane 21 has at least one screwdriver hole 3. The plane 21 has a drill holster 8. The plane 21 has a hammer/pipe wrench hole 5. The plane 21 has a channel lock slot 2. The plane 21 has a pipe holder 10 extending along the length of the pipe for holding pipe.

Preferably, the plane 21 has at least one tool lasso slot 1. The plane 21 preferably has a first quart recess and a second quart recess disposed adjacent the first quart recess. Preferably, the plane 21 has graduated lines for measuring items. The plane 21 preferably has a pint recess 9 disposed about the drill holster 8. Preferably, the bin 6 is disposed in the first quart recess. The pint recess 9 preferably is disposed in the second quart recess.

Preferably, the plane 21 has a tape measure holder slot 11. The top 12 preferably includes a screwdriver image 25 adjacent the screwdriver slot. Preferably, the top 12 includes a tape measure image 24 adjacent the tape measure slot. The top 12 preferably includes a channel lock image 26 adjacent the channel lock slot 2. Preferably, the plane 21 has a left side and a right side. The graduated lines preferably are ⅛ inch intervals apart. Preferably, the image is an icon part of the plane 21 or a label.

The present invention pertains to a method for using a ladder top 12 for a stepladder. The method comprises the steps of obtaining small parts from a bin 6 in a plane 21. There is the step of placing at least one screwdriver in a screwdriver hole 3 in the plane 21 for holding the screwdriver. There is the step of placing a drill in a drill holster 8 slot in the plane 21. There is the step of placing a pipe wrench in a pipe wrench hole in the plane 21. There is the step of placing a quart can of glue in a first quart recess disposed adjacent the second quart recess in the plane 21. There is the step of placing a channel lock in a channel lock slot 2 in the plane 21. There is the step of placing a pipe in a pipe holder 10 along a length of the plane 21.

The thermo plastic top 12 is designed for a IA extra heavy duty, reinforced fiberglass step ladder. The ladder comes in a number of different sizes.

The top 12 has many new features designed especially for pipe trade professional. The top 12 has two screw driver holes 3, a channel lock slot 2, a hammer/pipe wrench hole 5, and a drill holster 8. Some of the features have a raised icon next to it for easy identification.

Tool Lasso slots 1 are located off of the back surface of the top 12. These slots 1 hold bungee straps that can be connected to a variety of power and non power tools professional plumber's use daily. Once the bungee is secured to the tool the user can place the ball end of the system into the slot 1 for storing while he is working on the ladder. The slots 1 are also able to accept accessories that are designed to fit into the slot 1 that are directly designed for professionals.

The pipe holder 10 is located near the rear 23 of the top 12. This holder 10 is designed to hold a plurality of sizes of pipes and tubing used by plumbers. The tradesman can use this combination slot 10 to hold the pipes and tubes while working on the ladder. The slots 10 give the user an extra hand and help prevent the materials from rolling off of the top 12.

The small parts tray/propane tank holders is a deep bin 6 used to hold a variety of small parts pipe tradesman use on a daily basis. The bin 6 is shaped to hold the bottom of a propane tank securely when not in use.

Two deep quart recesses 7 are set side by side to hold the taped pipe cleaner and glue used to assemble plastic pipe. A pint recess 9 is located around the drill holster 8.

The top 12 also features a tape measurer holder slot 11. The user can place the clip portion of the tape measure in the slot to securely fasten it to the top 12.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for using a ladder top on a stepladder comprising the steps of:

providing a one-piece plastic ladder top having a plane having a front and a rear and a left side and a right side, the plane having at least one tool lasso slot for holding a ball and bungee strap unit, the plane has a top and a bottom, and the one lasso slot is wider at the top than the bottom and extending from the top to the bottom, the one lasso slot disposed at the rear of the plane in the rear side with an opening in the rear side which communicates with the one lasso slot so the bungee strap unit can fit into the one lasso slot, the plane having a pipe holder extending along the entire length of the top and in the first and second side for holding pipe, the plane having a bin for holding small parts, at least one screwdriver hole, a hammer/pipe wrench hole, a first quart recess and a second quart recess disposed adjacent and laterally with respect to the first quart recess to hold a pipe cleaner and glue, respectively, used to assemble pipe, and a drill holster, the bin for holding small parts has a shape to hold a propane tank; a front section having a first front rail and a second front rail in parallel and spaced relation with the first front rail, the front section extending from the top; and a rear section having a first rear rail and a second rear rail in parallel and spaced relation with the first rear rail, the rear section extending from the top, wherein the bin is disposed in the first quart recess and wherein the plane has a pint recess disposed about the drill holster wherein the pint recess and drill holster is disposed in the second quart recess;

obtaining small parts from the bin;

placing a tool lasso in the tool lasso slot;

placing at least one screwdriver in the screwdriver hole;

placing a drill in the drill holster;

placing a pipe wrench the a pipe wrench hole;

placing a quart can of glue in the first quart recess disposed adjacent the second quart recess;

placing a channel lock in a channel lock slot in the plane; and placing a pipe in the pipe holder along the length of the plane.

* * * * *